United States Patent [19]

Rice

[11] 4,160,516

[45] Jul. 10, 1979

[54] GARMENT HANGER CONSTRUCTION

[76] Inventor: Marjorie L. Rice, 1507 SW. Blvd., Kansas City, Kans. 66103

[21] Appl. No.: 930,687

[22] Filed: Aug. 3, 1978

[51] Int. Cl.[2] ..... A47J 51/086

[52] U.S. Cl. ..... 223/98

[58] Field of Search ..... 223/85, 88, 92, 98

[56] References Cited

U.S. PATENT DOCUMENTS

| | | | |
|---|---|---|---|
| 2,353,839 | 7/1944 | McFall | 223/98 |
| 2,581,631 | 1/1952 | Carta | 223/98 X |
| 2,813,668 | 11/1957 | Griffis | 223/98 |
| 2,819,829 | 1/1958 | Gensmer et al. | 223/98 |
| 3,157,324 | 11/1964 | Barnes | 223/88 |
| 4,066,193 | 1/1978 | Davis | 223/88 |

*Primary Examiner*—George H. Krizmanich

[57] ABSTRACT

The garment hanger construction comprises an attachment for a standard wire garment hanger. A pair of hanger bar attachment elements are secured on the downwardly inclined wire hanger bars and a pants bar attachment is secured on the wire pants bar. The attachments are of substantially greater width than the wire elements to which they are secured.

2 Claims, 5 Drawing Figures

GARMENT HANGER CONSTRUCTION

BACKGROUND OF THE INVENTION

The standard wire garment hanger commonly used for hanging clothes has the disadvantage of a narrow gage wire construction which causes creasing of clothes and slipping of clothes off of such hangers.

Wooden and plastic garment hangers are available. Such hangers have wider supporting areas which generally overcome the slipping and creasing problems. However, such hangers are relatively expensive.

The present invention provides an inexpensive attachment for wire garment hangers which converts such hangers to structures having wider support areas which overcome the slipping and creasing problems but which are inexpensive.

SUMMARY OF THE INVENTION

The garment hanger construction comprises a wire garment hanger having a triangular garment hanger portion. This portion has a pair of downwardly inclined hanger bars joined together at their lower ends by a pants bar. A suspending hook extends upwardly from the juncture of the hanger bars. A hanger bar attachment is secured on the hanger bars. The hanger bar attachment includes a pair of hanger bar attachment elements of substantially greater width than the wire hanger bars. Each has a groove on the underside thereof in which the hanger bars are received. The hanger bar attachment elements are joined together at their upper ends. An opening is provided at the juncture of the hanger bar attachment elements. The suspending hook extends through this opening. Strut means extend downwardly from each of the hanger bar attachment elements into engagement with the pants bar. A pants bar attachment of substantially greater width than the pants bar is secured on the pants bar. The pants bar attachment has a groove on the underside thereof in which the pants bar is received. Strut means extend from each end of the pants bar attachment into engagement with the strut means of the hanger bar attachment elements.

In the drawings

Figure 1:
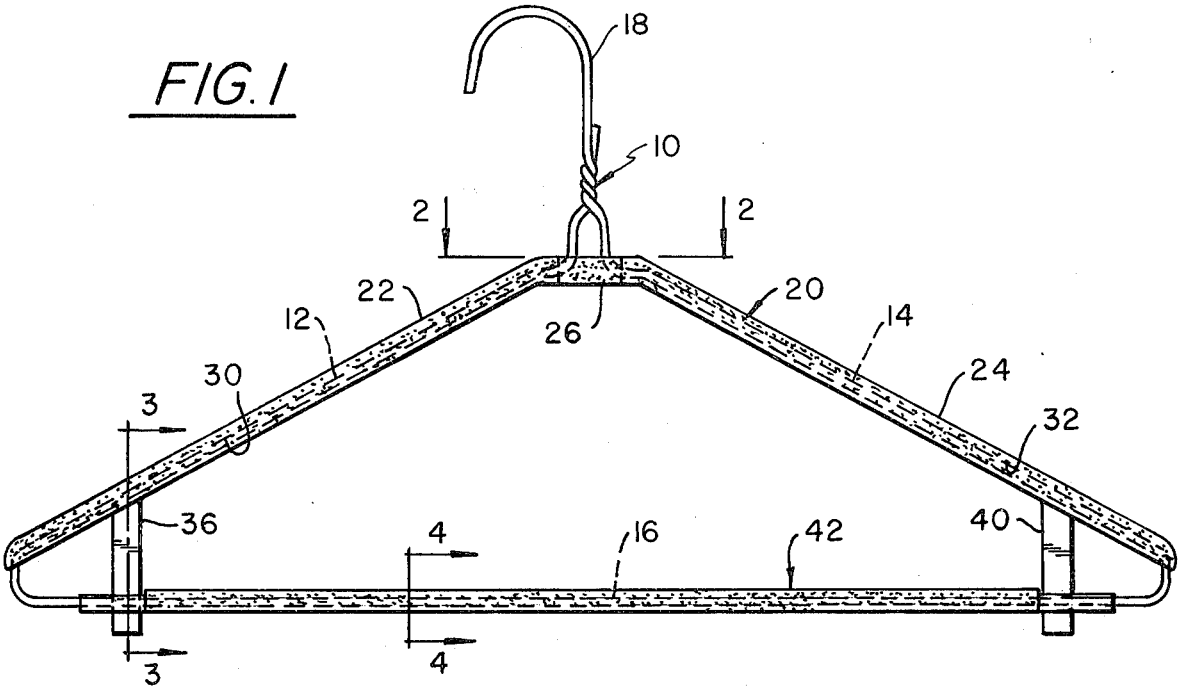
FIG. 1 is an elevational view of one embodiment of the garment hanger construction in accordance with the present invention.

Referring to FIG. 1, it will be noted that the invention is adapted to be used in connection with a standard wire garment hanger 10. The hanger 10 is of conventional configuration having a triangular hanger portion comprising a pair of downwardly inclined hanger bars 12, 14 connected together at their lower ends by means of a horizontally extending pants bar 16. A suspending hook 18 extends upwardly from the juncture of the hanger bars 12, 14. The hook 18 performs the usual function of suspending the garment hanger from a garment hanger element normally located in a closet.

Figure 2:
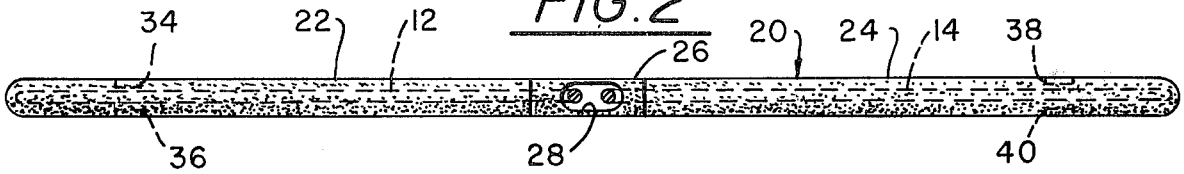
FIG. 2 is a sectional view taken substantially along the line 2—2 of FIG. 1 looking in the direction of the arrows.
Figure 3:
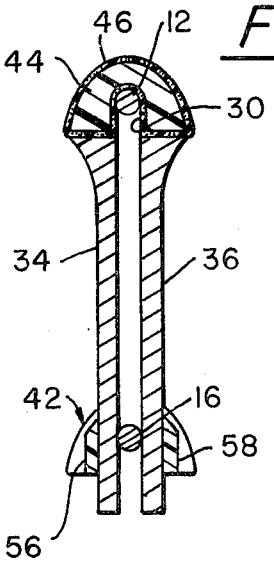
FIG. 3 is a sectional view taken substantially along the line 3—3 of FIG. 1 looking in the direction of the arrows.

A hanger bar attachment 20 is secured in place on the hanger bars 12, 14. As will be noted in FIGS. 2 and 3, the hanger bar attachment is relatively wide and has a curved upper surface. The increased width and curved surface provides a non-slip, noncrease hanger construction for clothes. Commonly, coats, jackets shirts, blouses and the like are hung on the hanger bar attachment 20. As is readily apparent, the width and gentle coverture of the hanger bar attachment provides substantially greater surface area than do the wire hanger bars 12, 14 to therefore eliminate the usual problems of slipping and creasing associated with such hanger bars.

The hanger bar attachment is formed by a pair of hanger bar attachment elements 22, 24, each of which generally conform to the length and inclination of the hanger bars 12, 14. The elements 22, 24 are joined together by structure 26 in which is provided an opening 28 through which the suspending hook 18 projects.

Elongated grooves 30, 32 are provided on the underside of each hanger bar attachment element 22, 24. The hanger bars 12, 14 are received in the grooves 30, 32 to thereby firmly secure the hanger bar attachment 20 to the garment hanger 10. A pair of spaced apart struts 34, 36, 38, 40 extend downwardly from the underside of each hanger bar attachment element 22, 24 adjacent the lower ends thereof. These struts extend over the pants bar 16 to thereby stabilize the hanger bar attachment from rolling. Additionally, in conjunction with struts provided on the pants bar attachment 42, the struts increase the rigidity of the entire garment hanger construction to thereby make it capable of sustaining heavier loads.

Each hanger bar attachment element is fabricated of a central core 44 of hard plastic or like material. The core 44 has a covering 46 of a relatively soft resilient material, for example foam rubber. The core 44 insures the hanger bar attachment elements of retaining their desired shapes. The cover 46 keeps garments from sliding. The outside cover 46 may be a full covering as shown or may be strips of material adhered to the upper surface of the core.

Figure 4:
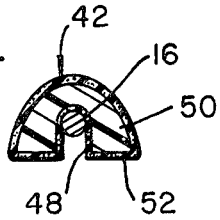
FIG. 4 is a sectional view taken substantially along the line 4—4 of FIG. 1 looking in the direction of the arrows.
Figure 5:
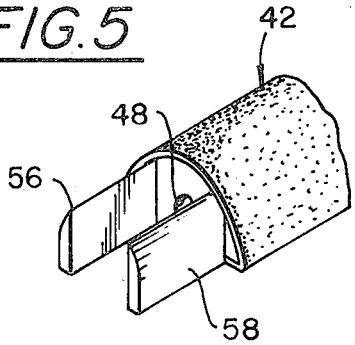
FIG. 5 is a view in perspective of one end of the pants bar attachment.

The pants bar attachment 42 is received on the pants bar 16 and extends between the struts 34, 36, 38, 40. As will be noted in FIG. 4, the pants bar attachment 42 is configured in the same manner as the hanger attachment elements, having a groove 48 for reception on the pants bar 16, a hard core 50 and a resilient covering 52. The upper surface is curved and the entire pants bar attachment 42 is substantially wider than the pants bar 16 for the aforementioned reasons.

A pair of outwardly extending spaced apart struts, 56,58 are provided at each end of the pants bar attachment 42. The struts 56, 58 are received over the struts 34, 36, 38, 40. The struts 56, 58 prevent roll over of the pants bar attachment 42 on the pants bar 16 and also rigidify the overall garment hanger construction.

The pants bar 42 is designed for use in hanging pants, slacks, skirts and the like without having these clothes crease or slip off the hanger construction.

Having thus described my invention, I claim:

1. A garment hanger construction comprising a wire garment hanger including a triangular garment hanger portion having a pair of downwardly inclined hanger bars joined together at their lower ends by a pants bar and with a suspending hook extending upwardly from the juncture of said hanger bars, a hanger bar attachment secured on said hanger bars, said hanger bar attachment including a pair of hanger bar attachment elements of substantially greater width than said hanger bars and each having a groove on the underside thereof in which said hanger bars are received, said hanger bar attachment elements being joined together at their upper ends, an opening at the juncture of the hanger bar attachment elements, said suspending hook extending through said opening, strut means extending downwardly from each of said hanger bar attachment elements into engagement with said pants bar, a pants bar attachment of substantially greater width than said pants bar, secured on said pants bar, said pants bar attachment having a groove on the underside thereof in which said pants bar is received, and strut means extending from each end of the pants bar attachment, each into engagement with the strut means of one of the hanger bar attachment elements; said strut means of the hanger bar attachment elements comprising a pair of spaced apart struts which extend around said pants bar, said strut means of said pants bar attachment each comprising a pair of spaced apart struts which extend over the struts of the hanger bar attachment elements.

2. A garment hanger construction as in claim 1, further characterized in that said hanger bar attachment elements and said pants bar attachment each comprise a core of relatively hard material, and a cover thereover of a resilient material.

* * * * *